United States Patent [19]

Decker

[11] 4,114,665

[45] Sep. 19, 1978

[54] WOODWORKING BENCH FOR PORTABLE MOTOR DRIVEN HAND TOOLS

[76] Inventor: Henry P. Decker, 2233 S. Alton Way, Denver, Colo. 80231

[21] Appl. No.: 683,911

[22] Filed: May 6, 1976

[51] Int. Cl.[2] ..... B25H 1/02

[52] U.S. Cl. ..... 144/286 R; 51/137; 144/1 R; 144/117 B; 144/134 A; 144/253 R; 144/285

[58] Field of Search ..... 144/285, 114 R, 117 R, 144/117 B, 134 R, 134 A, 286 R, 286 A, 1 R, 2 R, 253 R, 253 E, 253 F; 51/137, 141; 83/477.1, 5, 477.2; 33/120

[56] References Cited

U.S. PATENT DOCUMENTS

| | | | |
|---|---|---|---|
| 122,674 | 1/1872 | Spofford | 144/253 E |
| 1,552,340 | 9/1925 | Paul | 144/286 R |
| 1,947,885 | 2/1934 | Tautz | 144/253 J |
| 2,587,177 | 2/1952 | Larson | 144/286 R |
| 2,663,338 | 12/1953 | Fray | 144/286 R |
| 2,743,747 | 5/1956 | Franks | 144/286 A X |
| 2,782,817 | 2/1957 | Steiner | 144/117 B |
| 2,916,063 | 12/1959 | Boekenkamp | 83/5 X |
| 2,940,485 | 6/1960 | Zern | 144/253 F |
| 2,983,289 | 5/1961 | McKinley | 144/286 A X |
| 3,008,501 | 11/1961 | Hammer | 144/286 A X |
| 3,070,138 | 12/1962 | Baasland | 144/286 R |
| 3,841,188 | 10/1974 | Wiater | 83/477.2 X |

FOREIGN PATENT DOCUMENTS

| | | | |
|---|---|---|---|
| 1,402,564 | 1/1969 | Fed. Rep. of Germany | 51/137 |

*Primary Examiner*—Gil Weidenfeld
*Assistant Examiner*—W. D. Bray
*Attorney, Agent, or Firm*—Wm. Griffith Edwards

[57] ABSTRACT

A portable woodworking bench with collapsible legs is provided with a vertical wall or fence in two portions with a gap and opening between them and an arrangement for affixing a portable motor driven hand operated belt sander to the bench to provide a sanding surface normal to the smooth flat top surface of the bench. Precision finishing of surfaces at selected angles is effected by the use of guides quickly and easily secured on the bench top. A wide range of joints may be made quickly and accurately with precision finish. Various other motor driven hand tools including saws and routers may also be attached to the bench in positions for effective use as fixed position bench tools.

13 Claims, 14 Drawing Figures

WOODWORKING BENCH FOR PORTABLE MOTOR DRIVEN HAND TOOLS

This invention relates to woodworking equipment and particularly to an improved portable workbench including an arrangement utilizing power driven hand tools for accomplishing precision woodworking operations.

Portable electric motor driven hand tools such as saws, sanders and routers are used effectively in a wide range of operations both for industrial applications and in the home work shop. Many woodworking operations are best performed on non-portable equipment such as table saws, jointers, planers and the like. Such equipment is expensive and is not economical for infrequent use in a shop where it is installed. For many applications, portable equipment of this type would provide significant advantages. Motor driven hand tools such as saws, sanders and routers while performing excellently for the uses for which they are designed do not take the place of the table mounted equipment for precision work. Accordingly, it is an object of my invention to provide a readily portable woodworking bench arranged to use motor driven hand tools for precision woodworking operations.

It is another object of my invention to provide an improved workbench including an arrangement for utilizing motor driven tools for effecting precision woodworking operations.

Briefly, in carrying out the objects of my invention, in one embodiment thereof, a collapsible and portable workbench is provided having a smooth flat work top with a depending wall or flange which forms a shallow enclosure in which the supporting legs may be collapsed and where portable power hand tools may be held for transportation or storage. An upright wall or fence is provided on the top wall or table which provides smooth flat surfaces normal to the face of the table. The upright wall is formed by two sections spaced from one another near the center of the wall, and a mounting is provided to secure a portable motor driven belt sander in face alignment with the outfeed section of the upright wall and slightly in advance of the infeed section in parallel planes. The offset of this outfeed section is set for the normal depth of cut, a shim or shims being used for this purpose. A flat workpiece supported on the table and moved along the wall will thus be sanded to a smooth surface along the edge held against the wall to provide a finished flat surface at ninety degrees to that of the flat face of the workpiece. The degree of finish is determined by the selection of the grade of the grit of the belt.

The features of novelty which characterize my invention are pointed out with particularity in the claims annexed to and forming a part of this specification. My invention itself, however, both as to its organization and manner of operation, together with further objects and advantages thereof, will best be understood upon reference to the following description taken in connection with the accompanying drawings in which:

Figure 7:
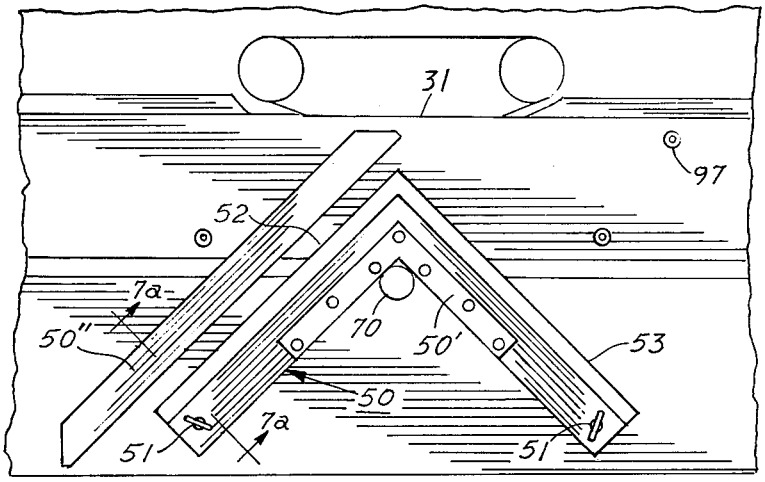
FIG. 7 is a top plan view showing angle guides in position.
Figure 7A:
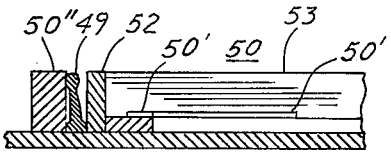
Figure 8:
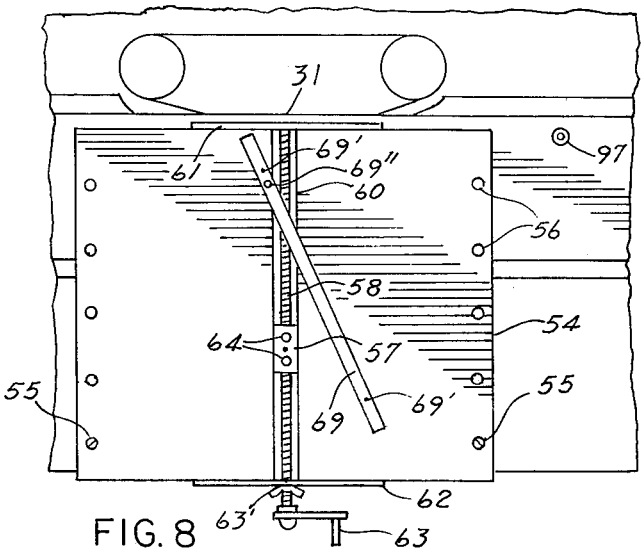
Figure 9:
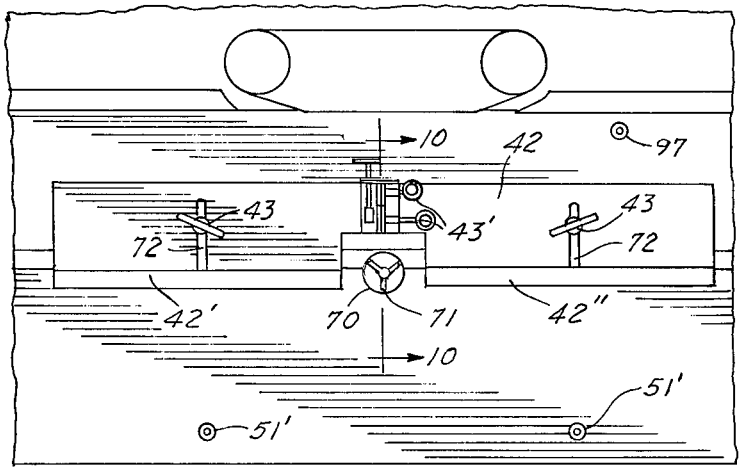
Figure 10:
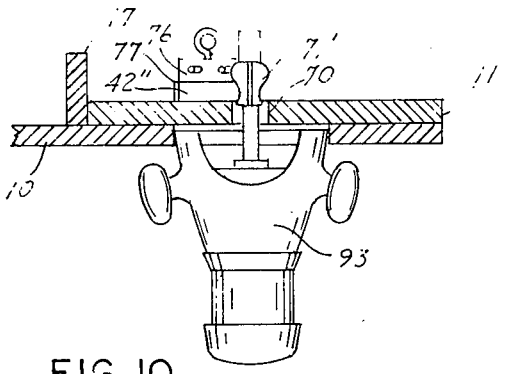
Figure 11:
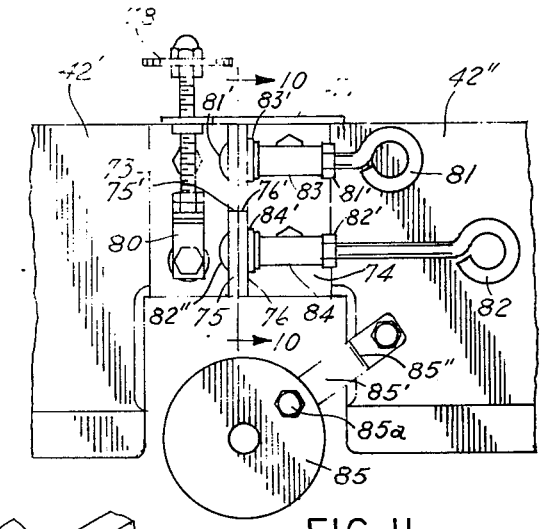
Figure 12:
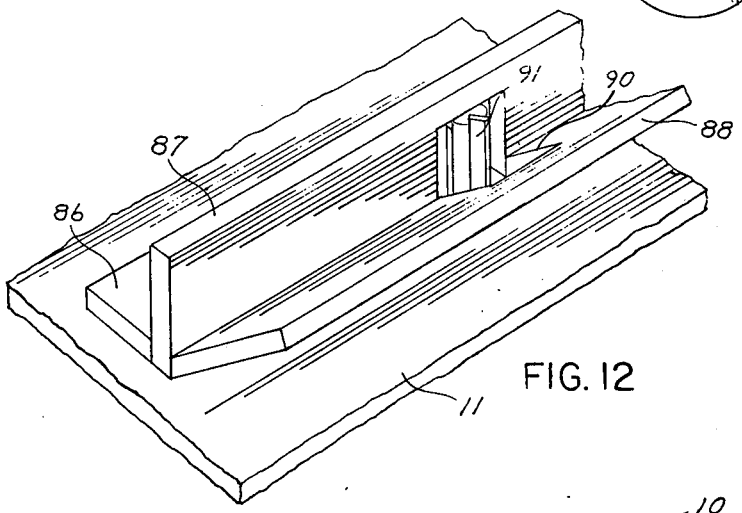

FIG. 7*a* is a sectional view along the line *a—a* of FIG. 7;

FIG. 8 is a view similar to FIG. 7 showing the set-up for making a circular workpiece;

FIG. 9 is a top plan view of the workbench with a router and guide fence in position;

FIG. 10 is a sectional view along the line 10—10 of FIG. 9;

FIG. 11 is an enlarged plan view of the center portion of the router fence;

FIG. 12 is a perspective view of another form of router fence; and

Figure 13:
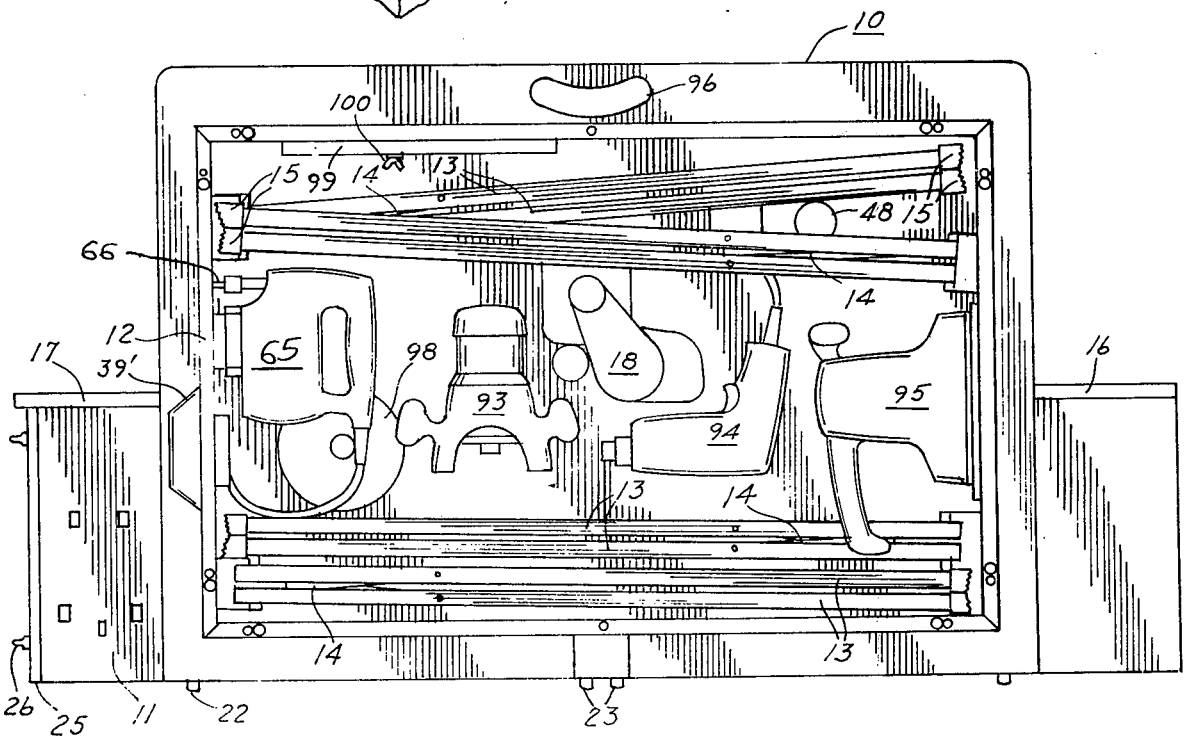

FIG. 13 is a bottom plan view of the workbench collapsed for carrying.

Figure 1:
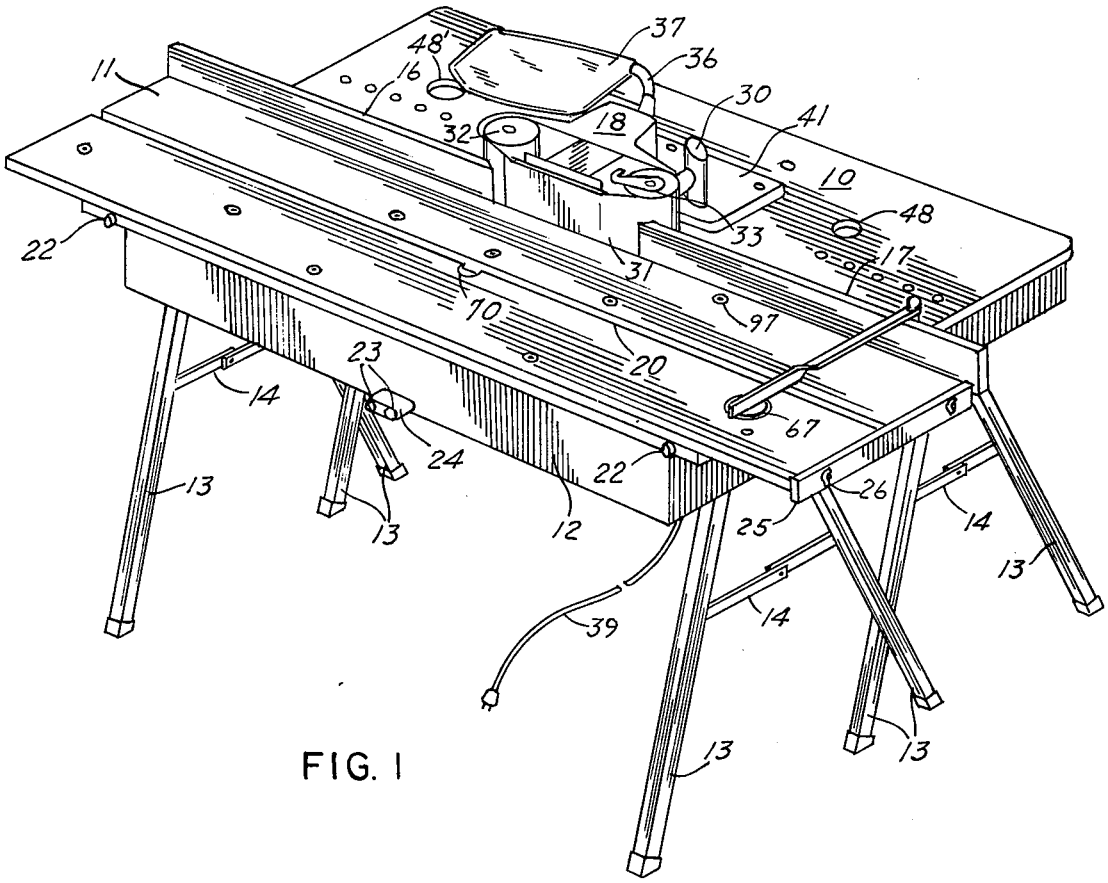
FIG. 1 is a perspective view of a woodworking bench embodying my invention.
Figure 2:
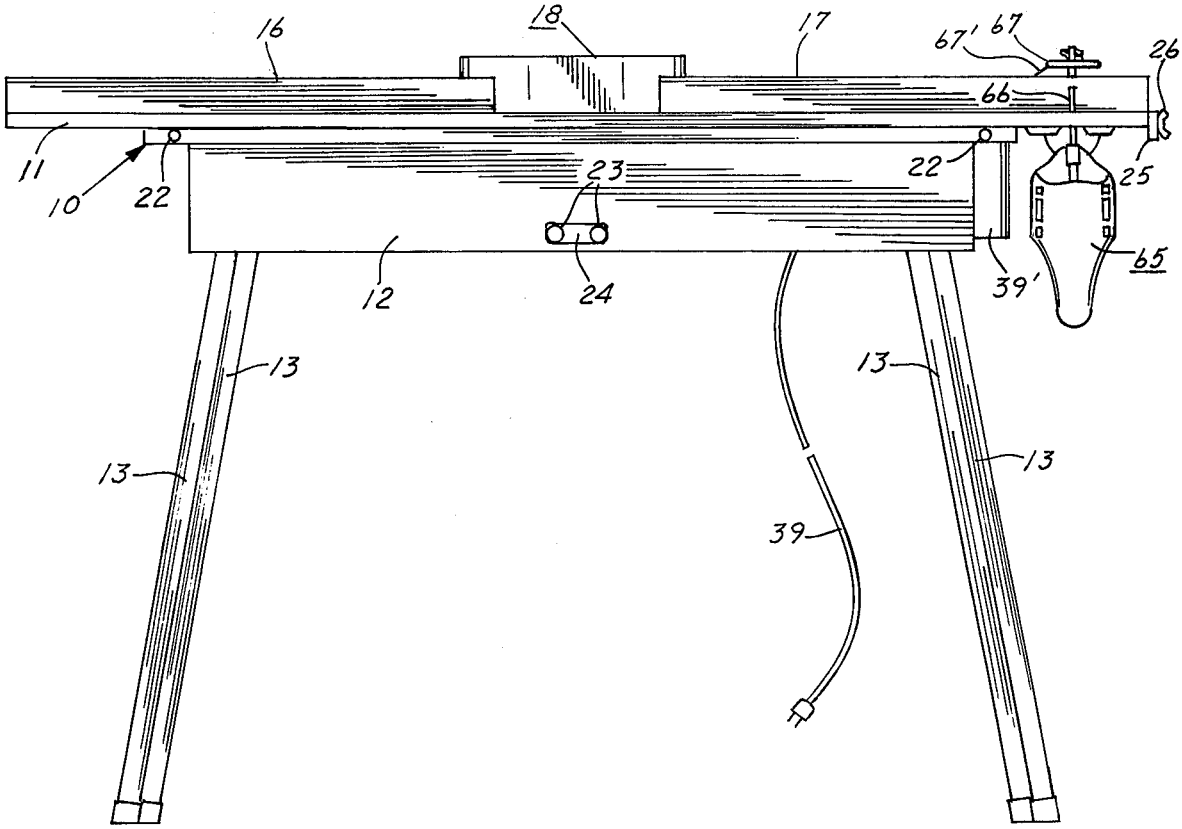
FIG. 2 is a front elevation.
Figure 3:
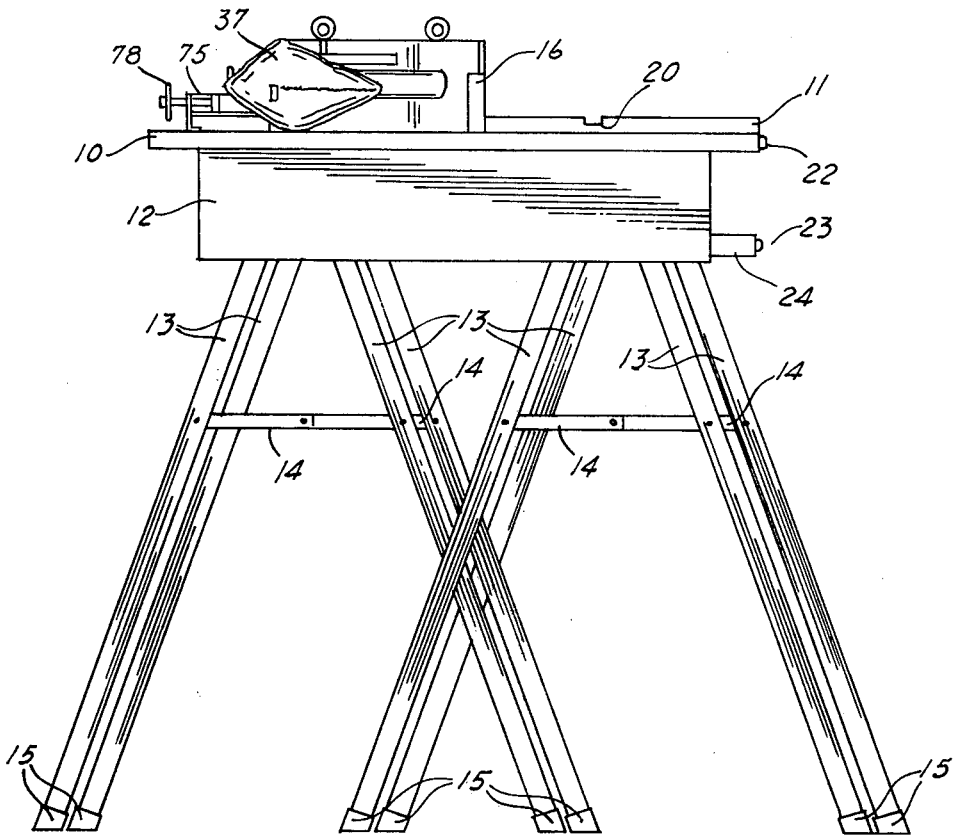
FIG. 3 is an end elevation from the left as viewed in FIG. 1.

Referring now to the drawings, the workbench illustrated in FIGS. 1, 2 and 3 comprises a flat-topped table 10 having a bench top or working surface 11 mounted on the forward half, the bench top being longer than the table 10 and extending substantially beyond it at both ends. Table 10 includes a reinforcing frame 12 formed by depending wall or frame members spaced inwardly from the edges of the table top and forming a rectangular box open at the bottom and which may be used as described below for holding motor-driven hand tools and accessory parts of the workbench. The workbench is supported on eight metal legs 13 arranged in pairs pivoted to the table 10 within the frame 12. Each pair of legs 13 is provided with a pivoted spreader bar 14, as shown in FIG. 3, spreader bars for the right-hand and left-hand sets of legs being in alignment as viewed in this figure. The legs 13 are thus arranged in slanting or inclined positions and, when viewed from the end as in FIG. 3, the far and near pairs of legs are offset with respect to one another. As shown in FIG. 2, the legs are also inclined outwardly from the ends of the bench. This arrangement of the eight legs inclined both longitudinally and laterally of the bench provides a rigid support. The feet of the legs are also provided with rubber tips or shoes 15 which afford a high friction engagement with smooth floors, as well as protecting the floors from the metal leg end.

Along the rear edge of the bench top 11, there is provided a fence or a wall comprising right and left hand sections 16 and 17, respectively, which are spaced from one another in their central portions to provide an opening for a portable belt sander 18 of a type presently available on the market. The bench top 11 is provided with a longitudinal guide groove 20 to facilitate the movement of adjustable work guides or the like along a path parallel to the face of the sander 18.

When the legs 13 are collapsed and folded within the frame 12, the workbench may be supported along the right-hand edge as viewed in FIG. 3, rubber bumpers or feet 22 and 23 being provided along the right-hand edge for engaging the floor or other supporting surface. The bumpers 23 are mounted on an extension or leg 24 which is offset, say one-fourth inch, so, with the bumpers 22, they support the surface of the table in a plane at a slight angle to the vertical.

The top surface of the bench table 11 and the vertical surfaces of the wall sections 16 and 17 are flat and smooth, the wall surfaces being at right angles to the surface 11. The surfaces thus cooperate to provide a guide for workpieces moved along the top 11 and into working engagement with the belt of the sander 18. At the right-hand end of the bench 11, there is provided a kick or stop plate 25 which may be positioned in alignment with the top surface of the bench 11, as shown in FIG. 2, or may be released by unscrewing wing nuts 26 and raised to a position extending above the top surface of the bench table 11 where it serves as a stop for a flat workpiece supported on the top of the bench and, being flat sanded with the belt sander in its normal hand-held position, the stop being held in its raised position by tightening the wing nuts 26. The thumb bolts used for attaching various tools or guides to the bench are eyebolts each provided with a disc or stop on its shaft for engaging the tool, guide or other part to be attached leaving the eye spaced substantially from the disc so that it is readily available for gripping and turning. The stops on the shafts of the eyebolts are set so that only four or five turns are required to secure the tool or guide—only the thumb and index finger are required to install the eyebolts.

Figure 4:
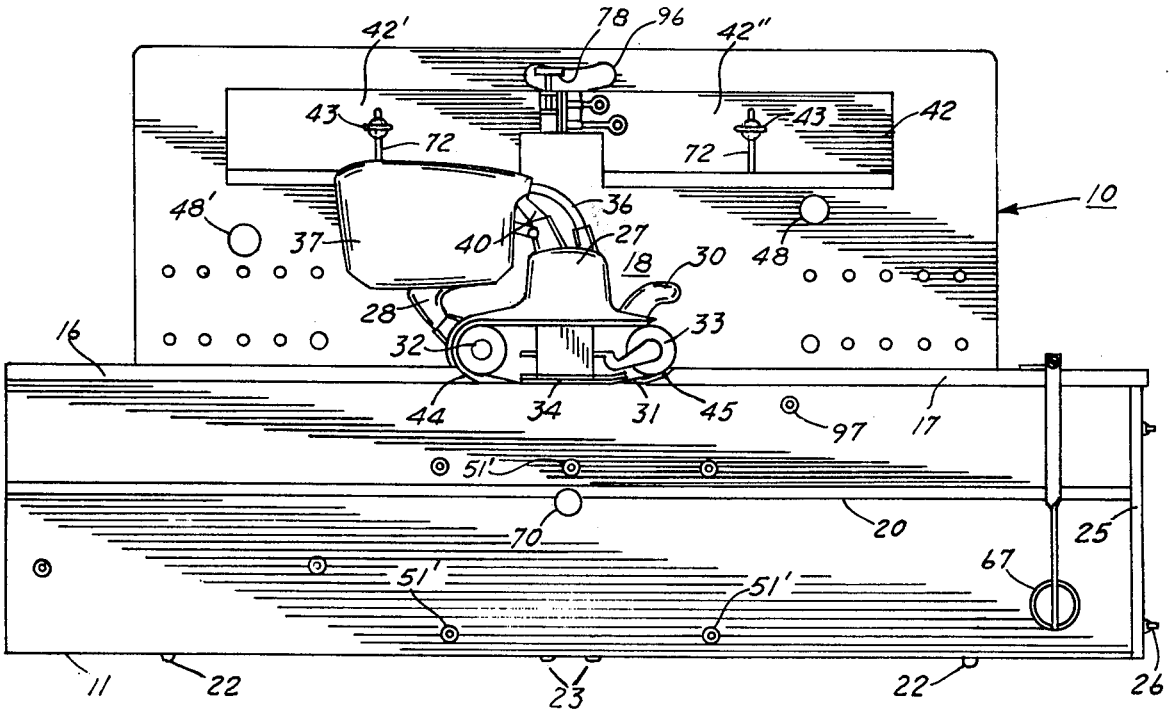
FIG. 4 is a top plan view.
Figure 5:
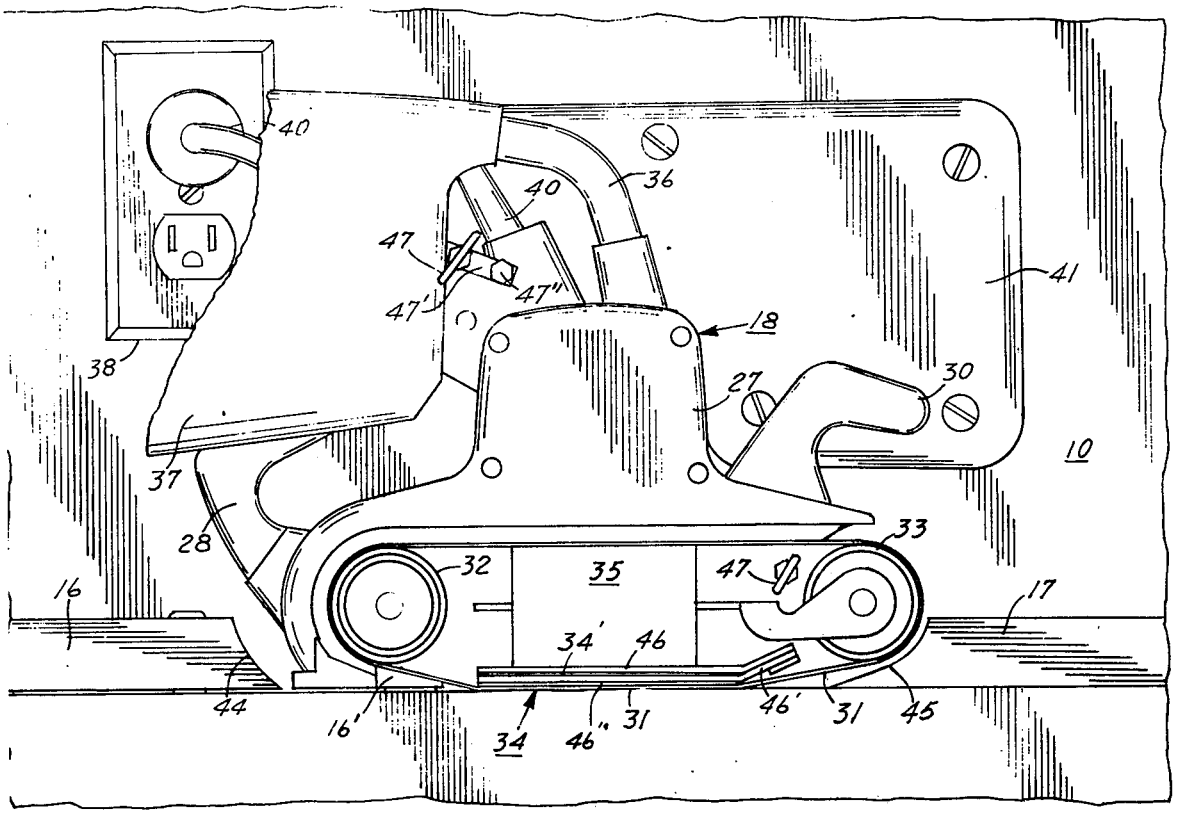
FIG. 5 is an enlarged partial plan view.
Figure 6:
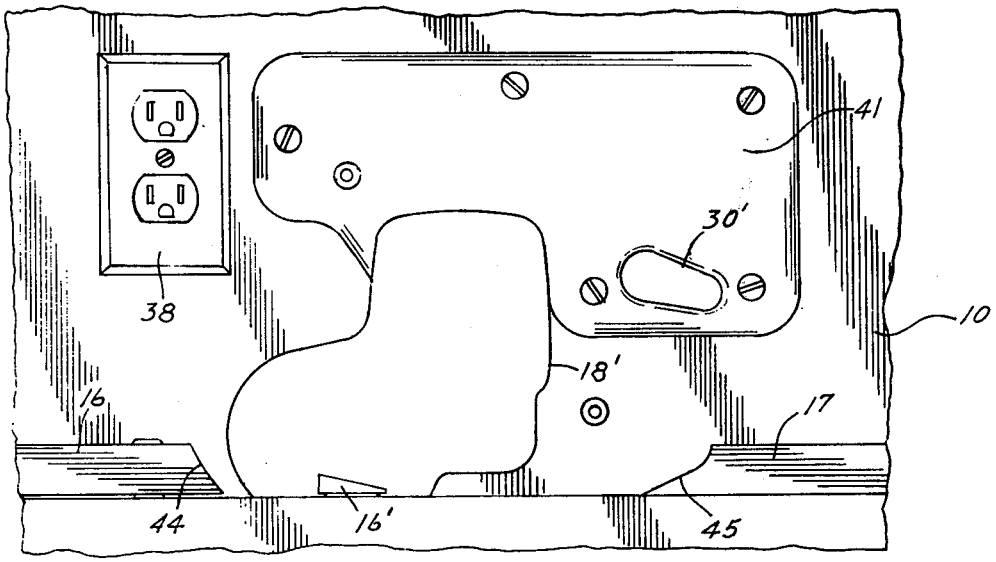
FIG. 6 is a view similar to FIG. 5 with the sander removed.

As shown in the plan views, FIGS. 4 and 5, the belt sander 18 comprises a housing 27 in which the motor is mounted, a main handle 28, a front handle 30 and a belt 31 which passes over a rear or driving pulley 32 and a front or idler pulley 33, the working portion of the belt being driven over a flat shoe or foot 34 to provide a flat working face. The foot 34 is mounted on a tracking box 35 which contains a biasing spring for urging the pulley 33 away from the pulley 32 and tensioning the belt. During the operation of the belt, dust is collected and flows through the housing 27 and out through a bag elbow 36 to a collecting bag 37, thereby minimizing the discharge of dust to the area around the workbench. A suitable electric lead 39 is provided for the workbench and is connected to a multiple plug recepticle 39' mounted at the right end of the table 10 and also to a recepticle 38, shown in FIG. 5, which is mounted on the top of the table adjacent the belt sander 18; these power outlets for a plurality of tools are provided on the bench. The power lead of the sander indicated at 40, is plugged into the recepticle 38. The sander 18 is secured in position adjacent the wall sections 16 and 17, in a manner to be described below and is seated or indexed to an opening 18' in the top 10 which conforms to the configuration of the closed side structure of the sander and further rests against a plate 41 mounted on the top of the table 10 and on which the front handle 30 rests in a recess 30'. A fence or guide 42 for use with a router has been indicated as attached to the table top 10 by detachable eyebolts or thumb screws 43. The walls 16 and 17 have been shown shaped or cut at 44 and 45, respectively, to accommodate the sander 18 with sufficient clearance. When the sander is in operation, the belt 31 is moved from right to left over the foot or shoe 34. The workpiece to be sanded is placed against the wall 16 which may be considered the front or infeed section and is moved along the wall against the sander, where it is reduced by removal of the cut and then passes on to the rear or outfeed section 17, the face of which is positioned in alignment with the face of the belt 31, where it passes over the foot 34. The difference in the positions of the faces of the wall sections 16 and 17 thus is selected in accordance with the depth of cut to be taken by the belt; and with changes in belt grit size. The depth of cut may, for example, be fifteen thousandths (0.015) inch. The positioning of the face of the outfeed wall 17 in relation to the face of the infeed wall 16 is accomplished by placing shims between the wall section 16 and the edge of the bench top 11 and is relatively permanent. The foot 34 comprises a fixed plate 46 and an attached plate 46' having a face steel shoe 46'' with a cushioning shoe 34' of cork or similar material shown mounted between the plates 46 and 46'. The plates 46 and 46' are normally in face engagement but may be separated by the shoe 34' and further by shim stock (not shown) which may be placed between the plates 46 and 46' for adjustment of the position of the face steel shoe 46''. The position of the bit 31 thus may be adjusted upon introducing shim stock of the desired thickness between the fixed plate 46 and the plate 46' with the cork shoe 34'. The finer the finish belt chosen, the heavier will be the shim stock required. It will now be understood that when a workpiece is moved along the infeed wall section 16, and moves across the sander to the outfeed wall section 17, it may be maintained in running engagement with both wall sections while its surface is being cut or finished by the sander. A metal guide 16' having its outer face aligned with the face of the wall section 16 prevents workpiece contact with the slope of the belt 31. The surface finished in this manner is in a plane at right angles to the flat finished surface of the bench top 11.

The sander is held firmly in engagement with its seat on the table 10 by eyebolts or thumb screws. The eyebolt 47 adjacent the top of the sander body engages a strap 47' secured to the sander by a bolt 47 so that the eyebolt lies adjacent the top edge of the handle 28. The degree of finish accomplished by operation of the sander is determined by selection of the grade of grit of the sandpaper used for the belt. The idler pulley 33 may be forced toward the pulley 32 against its spring bias to provide ease of installation and removal of the belt 31. This removal and replacement of the belt may readily be accomplished without removing the belt sander from its position on the table top.

The belt sander assembly, including the sander 18, the wall sections 16 and 17 and the flat bench top 11 may be employed for a wide range of precision finishing operations. In order to facilitate these various operations, guides or fixtures may be mounted on the bench top 11, and, by way of example, as shown in FIG. 7, a 45° angle guide 50 may be used. This guide comprises a flat base secured to the top of the table 11 by eyebolts or thumb screws 51 and arranged to provide two upstanding guide faces 52 and 53 at right angles to one another and to the face of the top 11; a flat angle piece 50' is attached to the guide base for reinforcement. The screws 51 engage a pair of attaching jack nuts or bushings 51' secured in the bench top as shown in FIG. 9. These and other attaching holes provided in the table and bench top are fitted with rigidly secured threaded jack nuts or bushings to receive the attaching screws. The faces 52 and 53 act as guides for movement of workpieces along their faces toward the belt 31 as it passes over the steel shoe 46''. The pieces to be finished with 45° angles are saw cut approximately to the desired angle and are then moved along one of the guide faces 52 and 53 into engagement with the face of the sander belt and are thereby finished to a true 45° angle by the use of the guide 50. Such angle cut pieces are highly accurate and may be joined to one another to form a precise right-angled joint. The guide member 50 is readily attached to and removed from the top of the table by use of the eyebolts 51.

Attaching or holding devices may be provided on the workbench for keeping tools and fixtures conveniently available when the workbench is in use. Thus, hooks (not shown) may be provided at the side and rear edges of the table 10 for hanging parts such as the workpiece guides; holes may be provided in the rear portion to receive screw drivers, eyebolts not in use or the like, and, by way of example, as shown in FIGS. 1 and 4 holes 48 and 48' are provided to receive the chuck of an electric drill and the router bit, respectively, when these tools are placed in readiness on the bench top.

A freely movable bar or guide 50'' shown in FIGS. 7 and *7a* may be employed with the guide 50 when, for example, cutting ornate faced molding for an outside corner. FIG. *7a* illustrates the position of the guides 50 and 50'' with a piece 49 of molding shown between the guides with its flat side against the bar 50''. Thus the flat side of the molding is held against the flat side of the bar 50'' to hold it in the required position at right angles to the bench top while the molding face is moved along the guide face 52 of the guide 50. This assures a correct angle cut of the molding corner. The bar 50'' is provided with one or more holes so that it may be attached to or hung from the bench when not in use.

Another fixture may be provided in order to produce circular workpieces, and is illustrated in FIG. 8. In this figure, a wooden plate 54 has been illustrated as attached to the top of the bench 11 by flat head machine screws 55 countersunk in the plate — one at each edge of the plate. A plurality of holes 56 are provided along the two edges of the plate, so that the distance of the plate from belt 31 may be selected by positioning the screws 55 in selected ones of the holes 56. The attaching holes 51' in the bench are a pair of the same holes as used for securing the angle guide 50 of FIG. 7. At the center of the plate, there is provided a groove or guide slot 60 in which is mounted a slide 57 which engages a threaded rod 58 rotatably mounted in the guide slot 60 by metal plates 61 and 62 along the opposite edges of the plate 54. The top of the plate is flat, the metal parts being flush with the surface or else countersunk. The rod 58 may be turned by a crank 63 to position the slide 57 at the desired distance from the sanding belt. The slide 57 is provided with threaded holes 64 in either one of which a machine screw may be secured. When a circular piece is to be produced, the workpiece is drilled to provide a center hole suitable to receive the screw to be inserted in the hole 64 and is roughed to the circular configuration. This may be done by use of a scroll or saber saw 65 mounted on the bench in the position illustrated in FIG. 2, the saw being mounted below the bench so that the blade of the scroll saw protrudes a short distance above the bench, as indicated at 66. A suitable guard indicated at 67 pivoted on a bracket 67' attached to the far side of the wall 17 is provided for safety. The workpiece is rough sawed by cutting along a circle marked on the piece and is then secured in position on the slide 57 by a machine screw pivot at the center of the circle and brought toward the sander by operation of the crank 63. When the circular workpiece is engaged by the sander, it is rotated by frictional engagement with the belt 31 and may be held by hand slightly to slow its rotation and produce a more effective cutting or sanding action, and when the cut has reached the marked circle, the piece is retained in position by a locking wing nut 63' which holds the center of rotation at a fixed distance from the belt until all portions of the circumference are finished to the same radius.

The plate 54 may also be used for securing an angle guide 69 in any desired position for cutting angles in a wide range from, say, 1° to 179° to the surface of the sanding belt 31. The guide 69 is a wooden bar straight along its sides and of square cross section. Two holes 69' near its ends are provided so that nails may be passed therethrough and driven into the plate 54 to secure the bar in the position required for the angle to be cut. Thus any desired angle in the range may be cut by locating the bar 69 at the angle; in locating the bar it may be pivoted on the slide 57 by a machine screw passing through a hole 69'' in the bar, or else a nail is inserted in one of the holes 69'; in either case the bar 69 is then pivoted about the screw or nail to the correct angle and then while the bar is held in that position a nail is inserted in the other hole 69' and driven into the plate to secure the bar against rotation about the pivot. The holes 69' and 69'' are drilled to the same size as the nails or screw to eliminate looseness. Work using the bar as described has been found to be highly accurate and precise.

The workbench may also be used with a portable router, and for this purpose the router fence 42 is removed from the back of the table top and is positioned in front of the sander with its center opening centered over a hole 70 through which the router tool or bit 71 protrudes. This arrangement is illustrated in FIGS. 9 and 10, which show the router positioned within the center opening between the two halves of the fence or wall 42 and extending forwardly to a distance sufficient for the depth of cut and design. The router bit may thus be employed in the manner of a shaper — the workpiece being moved along the fence 42 and held in position against the router to cut the required shape in the workpiece. Because the router is mounted upside down below the bench top the bit rotates counterclockwise as viewed in FIG. 9. Therefore the work is moved from right to left. In this manner, the router may be employed as a precision tool for the production of multiple, duplicate workpieces.

As shown in FIG. 9, the router fence 42 is constructed in two parts, an outfeed section 42' and an infeed section 42'' formed to provide an opening about the router cutter. The two halves are connected by fittings attached by two eyebolts 43' which allow the sections 42' and 42'' to be adjusted with respect to one another. The router may then be used as a vertical jointer when employing a straight cutter or with the wall sections in alignment and a molding bit, as shown at 71' in FIG. 10, may be used as a shaper. Slots 72 are provided in the base plate of the router fence to allow lateral movement with respect to the screws 43 when adjusting the positions of the fence.

FIG. 11 is an enlarged view of the central portion of the router fence shown in FIGS. 4 and 9. These views show the adjustment fittings for effecting precise positioning of the two sections of the router fence. The fittings for connecting the sections 42' and 42'' of the fence comprise angle pieces 73 and 74 bolted to the top faces of the adjacent ends of the sections 42' and 42'', respectively. The adjacent upright portions 75 and 76, respectively, of the angle pieces lie in face engagement. An angle plate 77 is attached to the rear of the section 42'', and extends over and above the section 42' so that it acts as a zero stop for the base 42' and also carries an adjusting screw 78 which is rotatable in the plate in a fixed position and is threaded to a block 80 attached to the horizontal portion of the angle piece 73. The upright portions 75 and 76 are locked together by tightening eyebolts 81 and 82 which are rotatably and slidably attached to the portions 75 and 76 and are threaded in elongated coupling nuts 83 and 84 in which they are locked by nuts 81' and 82'. The eyebolts are attached to the portions 75 and 76 by carriage bolts 81'' and 82'', respectively, passing through the upright portions 75 and 76 of the angle pieces. The square shoulders on the heads of the carriage bolts are slidable in horizontal slots in the uprights 75 and 76 and prevent rotation of the carriage bolts. Tightening of the eyebolts clamps the angle pieces together; when the bolts are loosened the angle pieces may be moved with respect to one another by turning the screw 78. This construction provides for the fine or vernier adjustment of the fence sections 42' and 42'' with respect to one another. Cross lines 75' and 76' marked on the top edge of the upright portions 75 and 76, respectively, are provided to indicate the position of adjustment of the sections 42' and 42''. The cross lines are shown in alignment indicating zero displacement of the sections. A circular guard plate 85 is pivotably mounted on the section 42'' by an arm 85' so that it may be positioned over the router bit to prevent accidental contact therewith, the arm 85' having an upwardly extending portion 85'' indicated in FIG. 11, to which the guard is attached by a bolt **85*a*** and held so that it clears the router bit.

FIG. 12 shows another form of router fence which comprises a base plate 86, an upright fence 87 and a forty-five degree plate 88, permanently attached to the bottom edge of the fence 87 and having an opening 90 to accommodate a router bit indicated at 91. This router fence or guide provides additional range of use of the router using molding bits. This base plate 86 of the router fence is attached to the bench top 11 by eyebolts (not shown) in the same manner as the fence of FIG. 9, and provides for the cutting of a workpiece at 45° to the router axis; other angles may be provided by similar fences with the plate 88 mounted at the desired angle.

The portable workbench as illustrated and described is readily set up in any desired location and is stable and firm in position. The workbench of the invention provides an arrangement whereby portable power hand tools may be employed for precision work and may thus readily be moved from one location to another and also may be collapsed and stored in a minimum space. This workbench is also suitable for commercial operations wherein a cabinet maker, or a finish carpenter for example, may move from one location to another, as from room to room, and thus has his tools readily at hand with minimum set-up time. Furthermore, the workbench of this invention is particularly well suited for use in the home workshop where the motor-driven hand tools may be desired for various other uses separate from the bench but may be attached readily to the bench for use in cutting precision workpieces and duplicate workpieces, as desired. The workbench assembly also provides a convenient arrangement for carrying the motor-driven hand tools from one location to another. Tools, in addition to the belt sander, being carried within the box or compartment formed by the frame 12 of the table 10. The arrangement of the table with the legs collapsed and additional motor-driven tools positioned within the housing 12 formed by the table as illustrated in FIG. 13, wherein the legs 13, as shown in their collapsed positions, and the saber saw 65, a router 93, a hand drill 94 and an orbital finishing sander 95 have been illustrated as secured within the box formed by the table frame 12. This entire assembly may be rested on the bumpers 22 and 23 and may be lifted and carried by gripping the upper edge of the table through a hand slot 96 provided centrally of the upper edge of the table. The various tools are secured to the table by eyebolts (not shown) which are used with the various threaded bushings provided in the table top, additional such bushings being provided as desired. Guides such as the router fences 42 and 86, the guides 50 and 50'', and the plate 54 may be secured to the top of the table for storage and transportation. Thus the router fence 42 is attached to the back portion of the workbench as illustrated in FIG. 4, and the bar 50'' may be placed along the fence portion 17 and secured by an eyebolt passing through a hole in the bar and into a bushing 97 adjacent the fence. Various other items may be secured within the table; for example, the router base plate is shown at 98, and a workpiece push stick at 99 secured by a wing nut 100. Thus, with the legs 13 folded the entire workbench, tools and other parts may be readily moved about, and quickly set up for work in different locations. The workbench of this invention thus increases the effective uses of motor driven hand tools. Other tools such, for example, as a vise, a bench grinder and a light portable drill press, may be mounted on the workbench if desired.

While the invention has been illustrated in connection with specific portable power hand tools and specific arrangements of the workpiece guides, various other applications and modifications will occur to those skilled in the art. Therefore, I do not desire my invention to be limited to the specific construction illustrated and described and I intend by the appended claims to cover all modifications which fall within the spirit and scope of my invention.

I claim:

1. A woodworking bench for utilizing a portable motor driven belt sander for the precision finishing of wooden workpieces, said bench comprising a top wall having a flat top surface and an upright wall rigidly attached to said top wall, said upright wall comprising two portions having an opening therebetween and having parallel flat front surfaces normal to said top surface, means providing a seat for receiving a portable sander of the type having a flat working face and for holding the working face in a position parallel to and in alignment with the face of one of said sections of said upright wall, and in advance of the face of the other of said sections, and means for securely holding the sander to said bench in said position of alignment.

2. The woodworking bench of claim 1 including downwardly extending reinforcing walls secured to the underside of said bench and forming an open box, and legs for said bench hinged to said bench and foldable into said box for storage and carrying.

3. The woodworking bench of claim 1 wherein the opening in said upright wall extends upwardly from said flat top surface whereby a workpiece in face engagement with said top wall may be finished with a ninety degree corner.

4. The woodworking bench of claim 1, including a separate plate havung a flat bottom surface for face engagement with said flat top, means for detachably securing said plate in a fixed position on said top, and guide means on said plate for guiding movement of a workpiece into engagement with the working face of the sander.

5. The woodworking bench of claim 1, including a guide for maintaining a workpiece in a predetermined angular position with respect to said working face of said sander during movement toward said working face, and readily detachable means for securing said guide in position on said flat top.

6. A woodworking bench as set forth in claim 1 including a flat plate detachably secured to the top surface of said top wall and having a smooth top surface parallel to said flat top surface of said top wall, means for pivotally mounting a flat workpiece for rotation about a vertical axis and in face engagement with said top surface of said flat plate with its edge in engagement with the belt of said sander whereby upon full rotation about its pivot said workpiece is finished in true circular configuration.

7. A woodworking bench as set forth in claim 6 wherein said means for pivotally mounting the workpiece includes a member carrying said mounting means and mounted in said plate and movable toward and away from said sander whereby the position of the pivotal mounting may be adjusted to the desired radius without removing the workpiece from said flat plate.

8. A woodworking bench as set forth in claim 6 wherein said flat plate has a groove therein positioned to lie along a line normal to said upright wall and a pivot attaching head movable along said groove, and an adjusting member at the end of said groove adjacent the edge of said flat plate remote from the sander for moving said head along said groove.

9. A woodworking bench as set forth in claim 1 including a straight guide for sliding engagement with a workpiece, and means for detachably securing said guide on said top wall adjacent said sander working face at selected angular positions with respect to said working face for affording movement of a workpiece in engagement with the guide toward and away from the sander at the selected angle.

10. A woodworking bench as set forth in claim 9 wherein said guide comprises a plate having a flat bottom surface for face engagement with the surface of said top wall, means for detachably securing said plate in face engagement with said top wall, and a separate straight guide element and means for attaching said element to the top face of said plate at any desired angle with respect to said upright wall.

11. A woodworking bench as set forth in claim 10 including a movable head mounted on said plate for movement toward and away from the belt of said sander and wherein said straight guide element comprises a bar for guiding a workpiece at a selected angle against the belt of said sander, means for pivoting said bar on said head and means on said bar for engaging a nail driven into said plate for securing said bar to said plate at the selected angle.

12. A woodworking bench as set forth in claim 1, including a guide fixture having a flat surface for face engagement with said smooth top surface of said top wall of said bench and having an upper flat surface extending in a plane transverse to said working face of said sander, and means for pivotally mounting a workpiece for rotation about a transverse axis normal to said upper flat surface and in face engagement therewith and with its edge in engagement with the belt of said sander whereby upon full rotation about its pivot said workpiece is finished in true circular configuration.

13. A woodworking bench as set forth in claim 12 wherein said means for pivotally mounting the workpiece includes a member carrying said mounting means and mounted in said guide fixture and movable toward and away from said sander whereby the position of the pivotal mounting may be adjusted to the desired radius without removing the workpiece from said guide fixture.

* * * * *